US008968166B2

(12) United States Patent
Cranke

(10) Patent No.: US 8,968,166 B2
(45) Date of Patent: Mar. 3, 2015

(54) SPORTS PERFORMANCE ENHANCEMENT SYSTEM

(75) Inventor: Christopher T Cranke, Upper Marlboro, MD (US)

(73) Assignee: True Form, LLC, Upper Marlboro, MD (US)

( * ) Notice: Subject to any disclaimer, the term of this patent is extended or adjusted under 35 U.S.C. 154(b) by 237 days.

(21) Appl. No.: 13/464,853

(22) Filed: May 4, 2012

(65) Prior Publication Data

US 2012/0283077 A1 Nov. 8, 2012

Related U.S. Application Data

(60) Provisional application No. 61/482,546, filed on May 4, 2011.

(51) Int. Cl.

| | |
|---|---|
| ***A63B 21/055*** | (2006.01) |
| ***A63B 21/04*** | (2006.01) |
| ***A63B 21/00*** | (2006.01) |
| ***A63B 23/035*** | (2006.01) |

(52) U.S. Cl.

CPC ..... *A63B 21/0552* (2013.01); *A63B 21/0442* (2013.01); *A63B 21/0557* (2013.01); *A63B 21/1415* (2013.01); *A63B 21/143* (2013.01); *A63B 21/1438* (2013.01); *A63B 21/1449* (2013.01); *A63B 21/1484* (2013.01); *A63B 23/03541* (2013.01); *A63B 23/03575* (2013.01)

USPC ..... 482/124; 482/121

(58) Field of Classification Search

CPC ..... A63B 21/02; A63B 21/028; A63B 21/04–21/0442; A63B 21/055–21/0557; A63B 21/1403–21/1434; A63B 21/1449

USPC ..... 482/69, 143, 78, 92, 122, 124, 126, 482/125, 139, 43, 129, 121; 2/300–342, 69

See application file for complete search history.

(56) References Cited

U.S. PATENT DOCUMENTS

| | | | | |
|---|---|---|---|---|
| 843,478 | A * | 2/1907 | Muller | 482/124 |
| 1,618,273 | A * | 2/1927 | Davidson | 482/124 |
| 2,097,376 | A * | 10/1937 | Marshman | 482/124 |

(Continued)

FOREIGN PATENT DOCUMENTS

| | | |
|---|---|---|
| GB | 245274 | 1/1925 |

OTHER PUBLICATIONS

International Search Report received in corresponding PCT/US13/39703 dated Aug. 30, 2013.

*Primary Examiner* — Loan H Thanh
*Assistant Examiner* — Rae Fischer
(74) *Attorney, Agent, or Firm* — Edell, Shapiro & Finnan, LLC

(57) ABSTRACT

A sport performance enhancing system includes a left glove, a right glove, a vest, a belt, a left shoe, a right shoe, and a plurality of resistance bands. The left glove and the right glove each consist at least one D-ring which provide the attachment of the left and right glove with the plurality of resistance bands. The vest also consist a plurality of vest rings that attaches with the plurality of resistance bands, attaching the left and right glove. A plurality of O-rings and a shoe D-ring in the left and right shoe are attached to the plurality of resistance band from one end, and the free end of the plurality of resistance bands attaches with a plurality of vertical rings and a plurality of horizontal rings which are positioned around the belt.

11 Claims, 19 Drawing Sheets

(56) References Cited

U.S. PATENT DOCUMENTS

| | | | | | |
|---|---|---|---|---|---|
| 3,162,441 | A | | 12/1964 | Karlik | |
| 3,999,752 | A | | 12/1976 | Kupperman et al. | |
| 4,273,328 | A | | 6/1981 | Ozbey et al. | |
| 4,596,387 | A | | 6/1986 | Roberts | |
| 4,728,103 | A | | 3/1988 | Fulton | |
| 4,815,729 | A | * | 3/1989 | Stefanski | 482/48 |
| 4,815,731 | A | | 3/1989 | Suarez et al. | |
| 4,993,705 | A | | 2/1991 | Tolle | |
| 5,186,701 | A | * | 2/1993 | Wilkinson | 482/125 |
| 5,203,754 | A | | 4/1993 | Maclean | |
| 5,263,916 | A | | 11/1993 | Bobich | |
| 5,433,688 | A | | 7/1995 | Davies | |
| 5,490,826 | A | | 2/1996 | Rose | |
| 5,518,480 | A | | 5/1996 | Frappier | |
| 5,545,113 | A | | 8/1996 | Bobich | |
| 5,653,668 | A | | 8/1997 | Wilkinson | |
| 5,683,336 | A | | 11/1997 | Pape | |
| 5,716,307 | A | * | 2/1998 | Vadher | 482/125 |
| 5,720,042 | A | | 2/1998 | Wilkinson | |
| 5,727,254 | A | | 3/1998 | Dicker | |
| 5,782,727 | A | | 7/1998 | Pierce | |
| 5,792,034 | A | | 8/1998 | Kozlovsky | |
| 5,800,319 | A | * | 9/1998 | Choate | 482/83 |
| 5,820,534 | A | | 10/1998 | Vadher | |
| 5,867,826 | A | | 2/1999 | Wilkinson | |
| 5,993,362 | A | * | 11/1999 | Ghobadi | 482/124 |
| 6,099,446 | A | | 8/2000 | Johnson et al. | |
| 6,361,516 | B1 | | 3/2002 | Hamel | |
| 6,962,555 | B2 | | 11/2005 | Behman | |
| 7,004,892 | B2 | | 2/2006 | Marco | |
| 7,087,003 | B1 | | 8/2006 | Katterjohn | |
| 7,261,679 | B2 | | 8/2007 | Sload | |
| 7,608,026 | B1 | | 10/2009 | Nicassio | |
| 7,618,356 | B1 | | 11/2009 | Johnson et al. | |
| 7,628,742 | B2 | | 12/2009 | Weaver | |
| 7,744,511 | B2 | | 6/2010 | Grigoriev et al. | |
| 7,794,368 | B2 | | 9/2010 | Rutherford | |
| 7,850,583 | B2 | | 12/2010 | Smith | |
| 8,142,336 | B1 | | 3/2012 | Yates | |
| 8,337,371 | B2 | | 12/2012 | Vollmer, Jr. | |
| 2002/0066208 | A1 | | 6/2002 | Hall | |
| 2004/0204302 | A1 | | 10/2004 | Flynn | |
| 2005/0043150 | A1 | | 2/2005 | Nitta et al. | |
| 2005/0261113 | A1 | * | 11/2005 | Wilkinson | 482/124 |
| 2006/0040805 | A1 | * | 2/2006 | Wilkinson | 482/124 |
| 2006/0183609 | A1 | * | 8/2006 | Flynn | 482/124 |
| 2007/0060454 | A1 | | 3/2007 | Vogel | |
| 2008/0287840 | A1 | * | 11/2008 | Koscielny et al. | 601/23 |
| 2009/0217550 | A1 | | 9/2009 | Koo | |
| 2011/0209264 | A1 | | 9/2011 | Williams et al. | |
| 2013/0045842 | A1 | | 2/2013 | Wood | |
| 2013/0067767 | A1 | | 3/2013 | Casto | |

* cited by examiner

SPORTS PERFORMANCE ENHANCEMENT SYSTEM

The current application claims a priority to the U.S. Provisional Patent application Ser. No. 61/482,546 filed on May 4, 2011.

FIELD OF THE INVENTION

The present invention relates generally to exercise equipment. Specifically, it is a total body sports performance enhancement system that allows the user to build strength at a faster rate through resistance training while keeping the hands free.

BACKGROUND OF THE INVENTION

Sports performance enhancement system can improve accuracy, endurance, precision, strength, efficiency, as well as several other key athletic and fitness attributes. Being an athlete and/or staying in shape require a lot of time and effort. Athletes must train their entire body in order to achieve total body fitness, which is a prerequisite in order to excel as a top tier athlete, as well as to obtain an optimal body condition. The rewards of such an achievement are immense yet the journey towards these pinnacles requires a great deal of time consuming dedication, and exertion. The problem is that normally the aspiring athletes and/or fitness enthusiasts would have to work out a vast array of different body parts such as, upper and lower body. Then, he or she must maintain his or her cardio by running and or jogging. Then in the case of the athletes, they would have to practice in that particular sport to improve and sharpen the skill set required for that particular sport. Therefore, there is a greater need for a versatile total body system that can save time yet not compromise on the rigorous training that serious competitors and fitness enthusiasts need to reach their goals while effectively activating multiple muscles at once.

Most devices that attempt to create a total body workout system fall short, because they never cover the entire spectrum of an effective complete body work out. There is no serious full body work out system that encompasses the foundation of free weight resistance. The two free weight exercises that represent the most power are bench presses and leg presses or leg squats. Each represent upper and lower body strength. Other exercises that represent the next best strength enhancement in free weights are arm and leg curls, as well as arm and leg extensions. This is the corner stone of free weight exercise. For years these strength enhancements have provided adequate strength and performance enhancement exercise for millions upon millions of people. But the problem that remains is that these strength enhancements exercises are very time consuming, and most devices that attempt to provide the full body workout are usually stationary exercises machines. The exercises mentioned above provide great workouts because the focus of resistance force is underneath the finger tips and inside the palm of the hand (in the case of upper-body workouts), or near the ankles (in the case of lower-body workouts). These upper and lower body exercise actions are so revolutionary because they incorporate two parts of the human body that make humans unique compare to any other species that has ever lived on this earth. The first part is the sole of the feet, which allows humans to walk upright. The second part is the fingers and palms of the hands that allow humans to build and create objects with their hands. The best way to improve the human body from the athlete's standpoint is to stay true to these focus areas while exercising.

It is also to be noted and reiterated that the inside of the hand and the bottom of the feet, particularly the balls of the feet, is the main point of focus for resistance force. Most athletes are limited to performing one workout in intervals, thus consuming a lot of time and also incorporating multiple body parts but losing the core points of focus in doing so. Since each workout is individually performed, each workout requires a specific amount of time. Becoming a great athlete is one of the most challenging tasks ever to accomplish. Great athletes perform many full body workouts for many years at an aggressive level.

Thus, resistance band training is a great alternative exercise tool that is not as stationary and provides a great workout with more creative capabilities. While exercising with resistance bands, an athlete or fitness enthusiast can get a great workout. Considering the resistance band workout equipment that's on the market today, whether it's a bow, or has twisting functions, or perhaps it can hang from a door, these products share a common oversight. These products occupy the hands of the athlete resulting in restricted use of the equipment. However, these products are intended to provide resistance to the workout by use of some sort of handle, but these products have limited usage for an aspiring athlete due to the confined parameters in which they were designed.

Different athletes have different skilled sets. For example, in the game of basketball certain athletes can have better low post games while other athletes have better shooting abilities. Most of the time, the athlete with a better low post game may want to improve his or her shooting skills. Most of the existing products in the present market seem too general and not specific enough to improve the shooting skills. The existing products also occupy the hands of the athlete. Since the hands are occupied with the existing products during the exercising process, there is a disconnection between the exercising process and the skill practice of any given sport. The present invention allows the athlete to combine the exercising process and the skill practice within any given sport. The present invention allows the athletes to exercise with the traditional resistant bands while keeping their hands free. However, the important aspect of the present invention is to keep the focus of resistance underneath the finger tips, in the center of the hand just as a handle would, and underneath the foot, the sole of the foot, thus the present invention allows perfect balance to the athletes.

The present invention creates a resistant band mechanism that would provide the same benefits as the traditional resistant bands but allow freedom to the hands so that the athletes can add the present invention to their already existing practice routine. Although the original intention of the present invention was for improving basketball shooting skills, the present invention can be used for a vast array of sports. The present invention would allow the athletes to practice a wide range of movements relative to their sport, while they practice. The present invention contrasts with the traditional resistant band technology because the present invention provides freedom to the athlete's hand while exercising. The present invention not only saves time but concurrently activates multiple full body muscle groups without compromising the key points of resistance force in the defined special areas.

There are usually two to three key areas, such as weight resistance, cardio, and practice in the particular sport, that the athletes and fitness enthusiasts must work out to excel in their respected discipline. Therefore, it is the objective of the present invention to provide the user with benefits of all three areas to maximize the quality of each workout while minimizing time. For weight resistance, the present invention uses resistance bands in specialized areas, previously undone by any products on the market. For cardio, the present invention uses constant resistance as a method to cover the area for cardio. For practice in a particular sport, the present invention can be worn during the entire practice session. The present invention incorporates all three areas simultaneously thus not only saving time, but maximizing the time spent training to the fullest potential. A multitude of sports can use the present invention. For example, the present invention can be used when a receiver attempts to catch a ball in a football game or also when a quarterback attempts to throw a football.

DETAILED DESCRIPTIONS OF THE INVENTION

All illustrations of the drawings are for the purpose of describing selected versions of the present invention and are not intended to limit the scope of the present invention.

Figure 17:
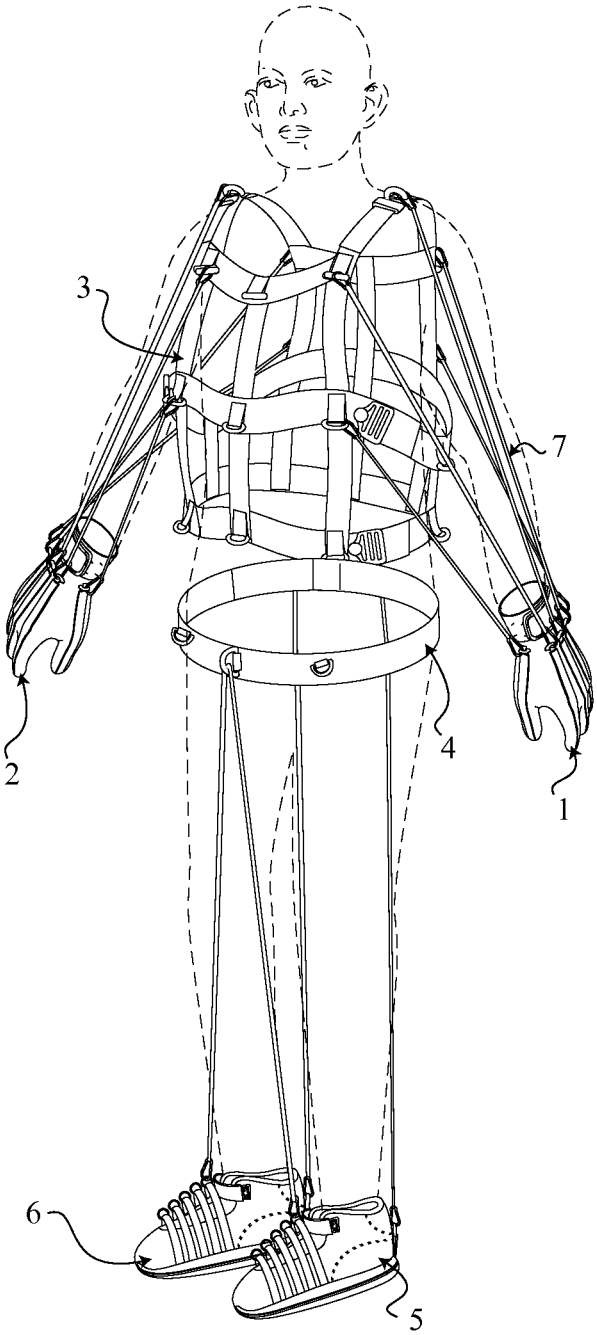
FIG. 17 is a perspective view of the present invention.
Figure 18:
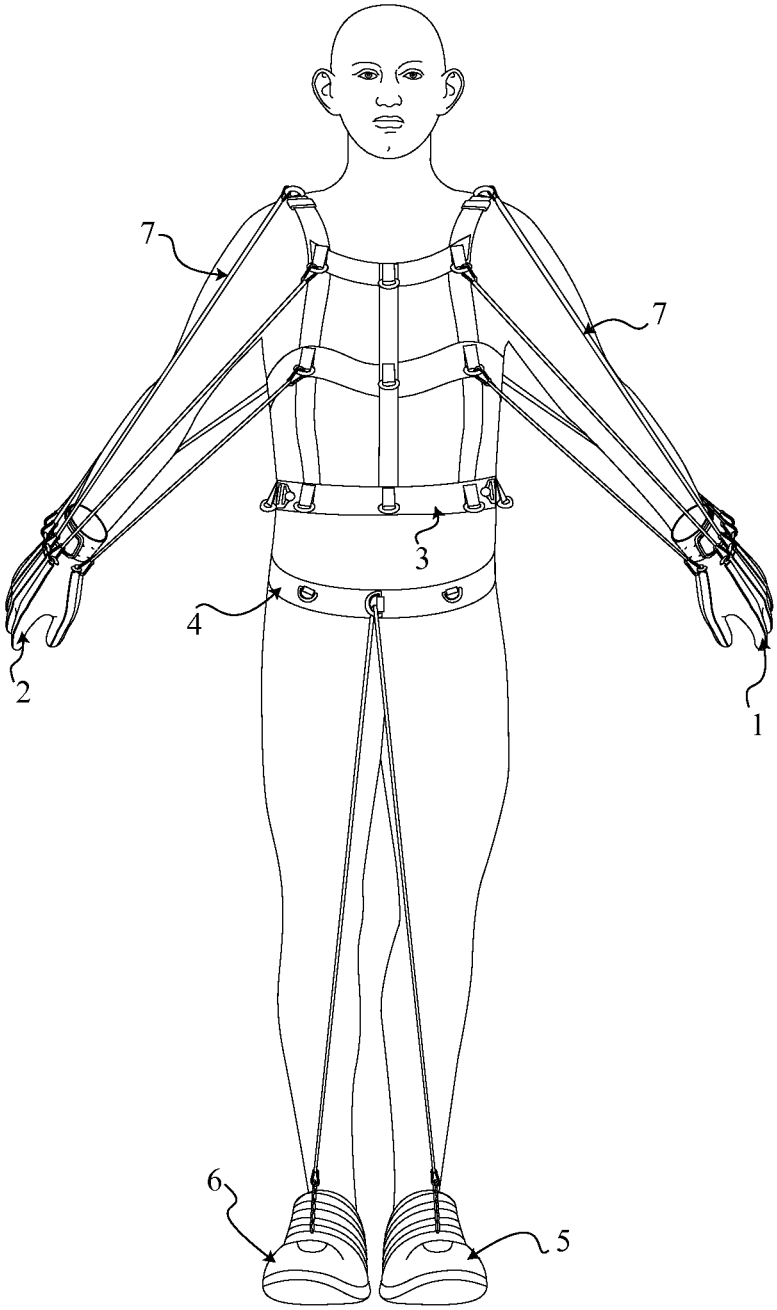
FIG. 18 is a front perspective view of the present invention.
Figure 19:
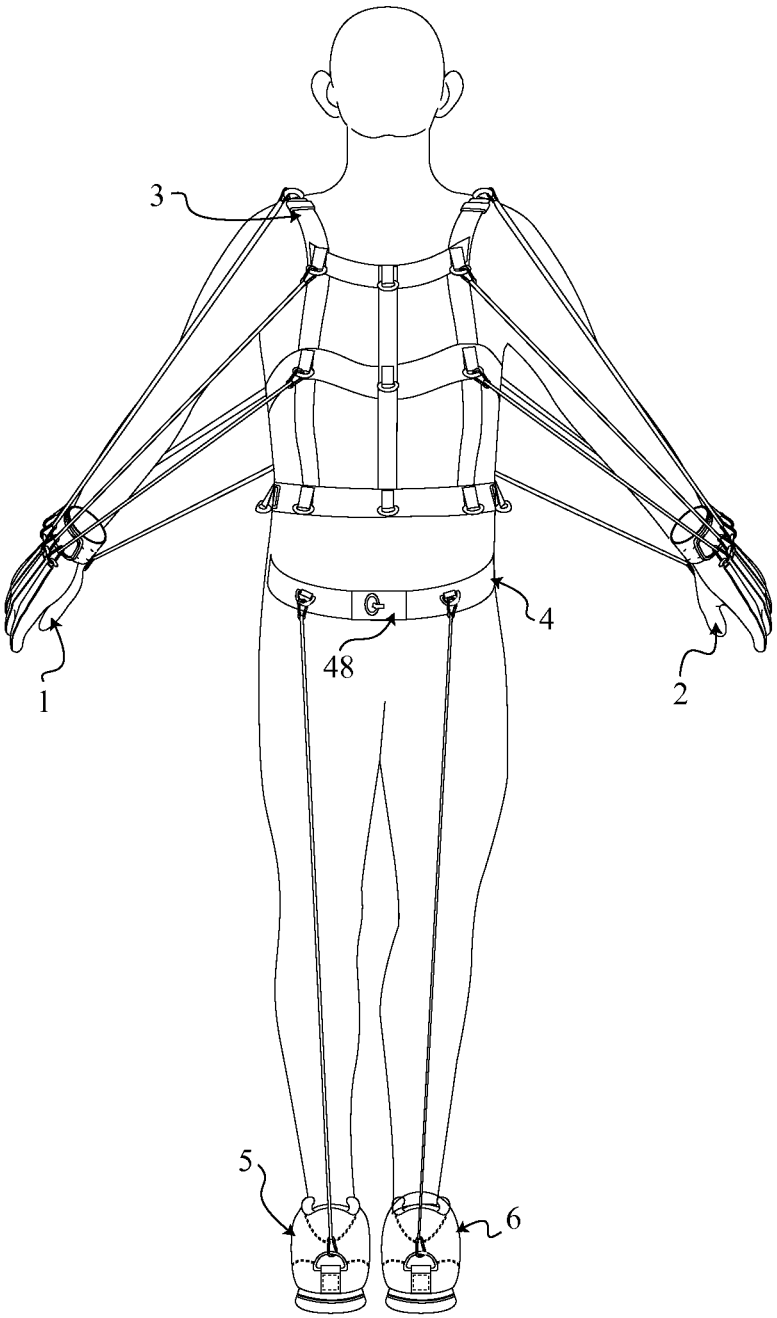
FIG. 19 is a back perspective view of the present invention.

In Reference to FIG. 17, FIG. 18, and FIG. 19, the present invention comprises a left glove 1, a right glove 2, a vest 3, a belt 4, a left shoe 5, a right shoe 6, and a plurality of resistance bands 7. The left glove 1 and the right glove 2 are attached to the vest 3 by the plurality of resistance bands 7, and the left shoe 5 and the right shoe 6 are attached to the to the belt 4 by the plurality of resistance bands 7.

Figure 1:
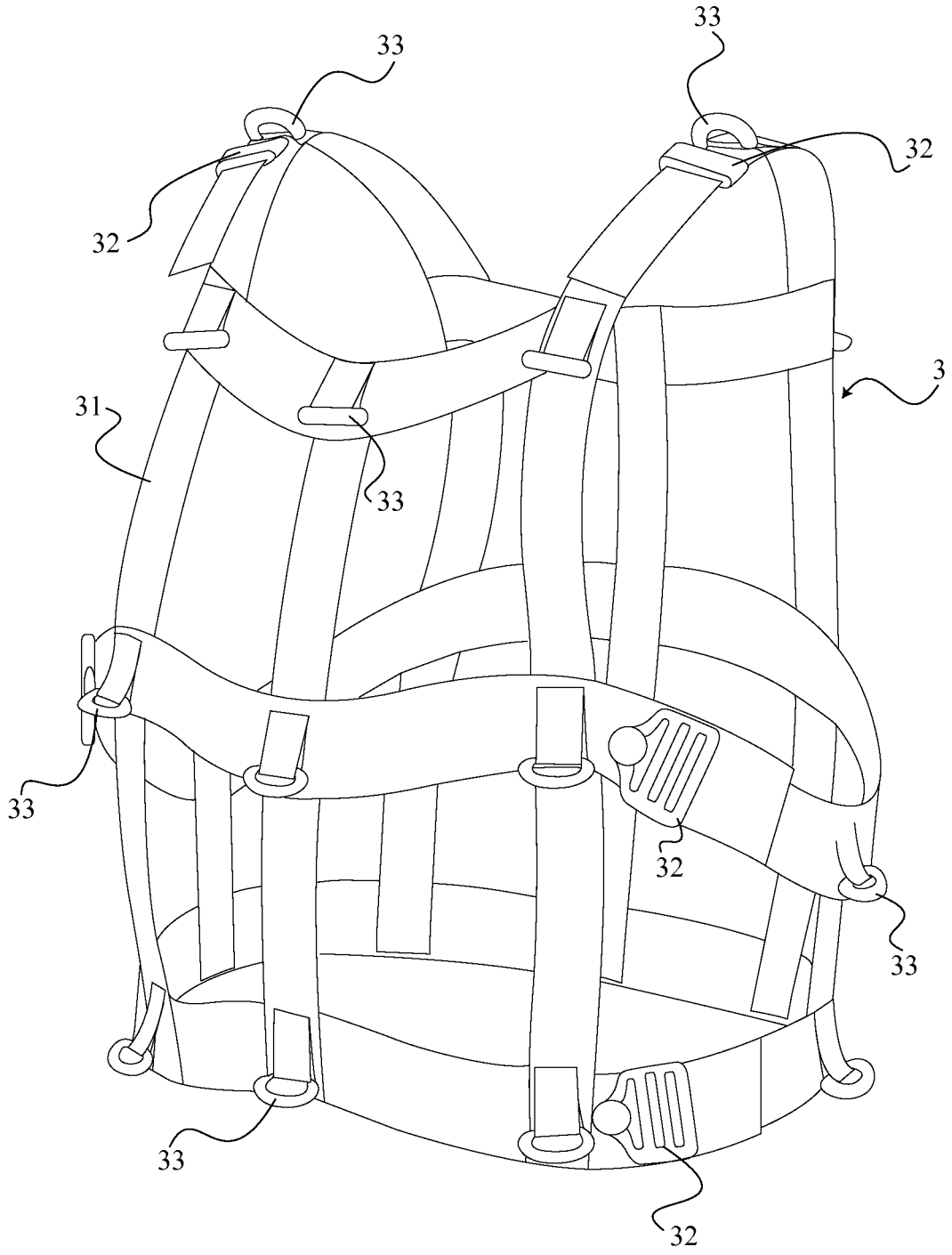
FIG. 1 is a perspective view of the vest.
Figure 2:
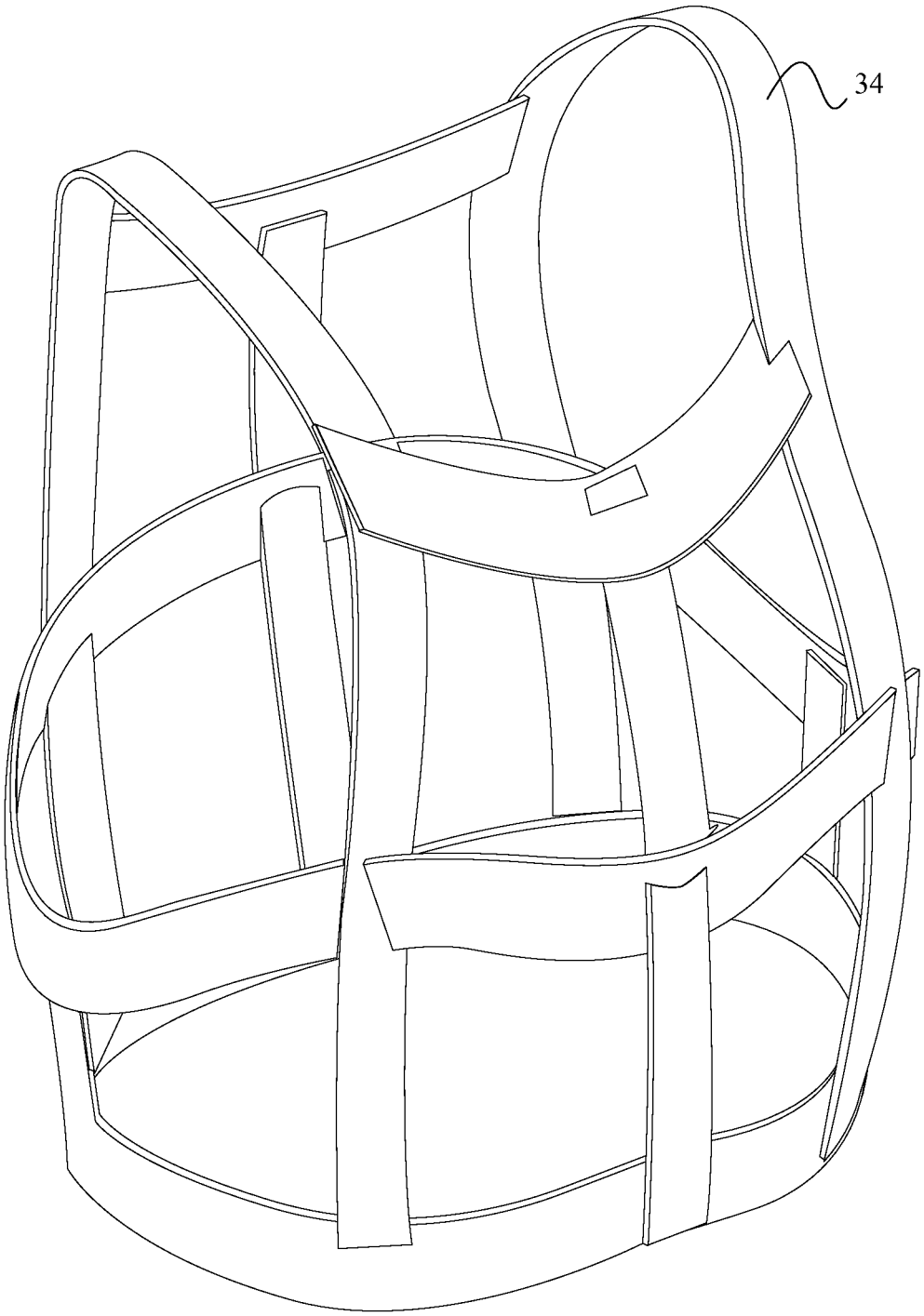
FIG. 2 is a perspective view of the inner vest frame.

In reference to FIG. 1 and FIG. 2, the vest 3 comprises a strap frame 31, a plurality of vest adjustable straps 32, a plurality of vest rings 33, and an inner vest frame 34. The vest 3 is positioned around the upper body of the user, and the vest 3 is secured to the user around the chest area and back area. The inner vest frame 34 is connected to the strap frame 31 from the inside surface. The inner vest frame 34 is made from low density visco-elastic polyurethane foam or any other related materials. Since the inner vest frame 34 is pressed against the user's body, the inner vest frame 34 deforms according the shape of the user's body. The strap frame 31 is made from a plurality of straps, and the strap frame 31 has a shape of a human upper body. The plurality of straps comprises a plurality of flexible girth straps and a plurality of flexible elongated straps. The plurality of flexible girth straps is positioned perpendicular with the plurality of flexible elongated straps. The strap frame 31 is made from nylon straps or any other related materials similar to nylon so that the strap frame 31 is able to absorb multi-direction moving forces and deform according to the user's body shape. The plurality of vest adjustable straps 32 is connected to the strap frame 31 around the strap frame's 31 left side, right side, and shoulder areas. Once the user puts on the strap frame 31, the strap frame 31 can be tighten to the user's body by the plurality of vest adjustable straps 32. In the preferred embodiment, the plurality of vest rings 33 is movably connected to the strap frame 31 by a plurality of fastenings. The plurality of fastenings allows the plurality of vest rings 33 to freely moves so that the movement of the plurality of vest rings 33 is not limited. The plurality of fastenings can be stitched, glued, riveted (or use any combination thereof) to the strap frame 31. The plurality of vest rings 33 is positioned on the back side of the strap frame 31 and the front side of the strap frame 31. Additionally, 360 degree rotatable rings can be used as the plurality of vest rings 33.

In reference to FIGS. 12-14, and FIG. 19, the belt 4 comprises a belt adjustable strap 41, a double D-ring belt buckle 42, a plurality of vertical rings 43, a plurality of horizontal rings 44, an inside belt loop fastener 45, an outside belt loop fastener 47, a belt hook fastener 46, and a back attachment 48. The double D-ring belt buckle 42 is connected to the belt 4 from a first belt end, and the belt adjustable strap 41 is connected to the belt 4 from a second belt end, wherein the first belt end and the second belt end are positioned at the opposite ends of the belt 4. The belt adjustable strap 41 has the outside belt loop fastener 47 and the belt hook fastener 46 on the outside surface. The belt hook fastener 46 is connected to the belt adjustable strap 41 from one end, and the outside belt loop fastener 47 extends from the belt hook fastener 46 to the second belt end. The inside belt loop fastener 45 is connected to the inside surface of the belt adjustable strap 41 and extends along the belt adjustable strap 41. The belt adjustable strap 41 is inserted through the double D-ring belt buckle 42 and then inserted between the double D-ring belt buckle 42 so that the belt adjustable strap 41 functions as a securing method for the belt 4. The belt hook fastener 46 also attaches to the outside belt loop fastener 47 providing additional attachment to the belt 4. Since the belt adjustable strap 41 allows the user to adjust the belt 4 according to the user's girth circumference, the belt 4 can be fitted with different body structures. The plurality of horizontal rings 44 and the plurality of vertical rings 43 are movably connected along the belt 4 by the plurality of fastenings. The plurality of horizontal rings 44 and the plurality of vertical rings 43 can be either D-rings or O-rings. The plurality of horizontal rings 44 is positioned parallel with the belt 4, and the plurality of vertical rings 43 is perpendicularly positioned with the belt 4.

Figure 12:
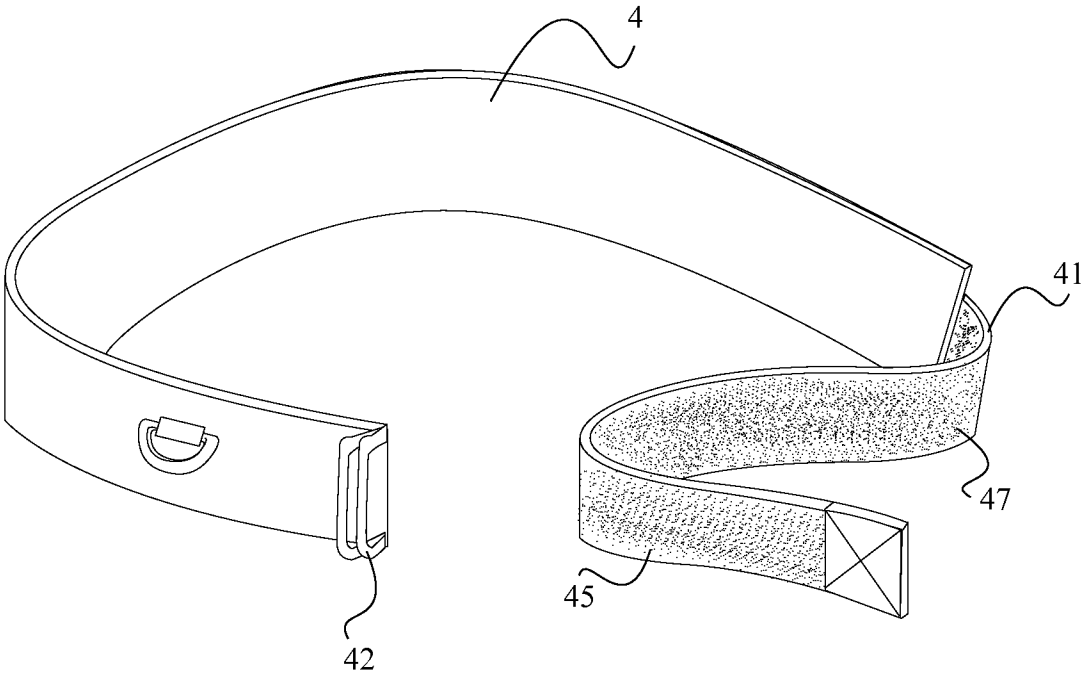
FIG. 12 is a back perspective view of the belt.
Figure 13:
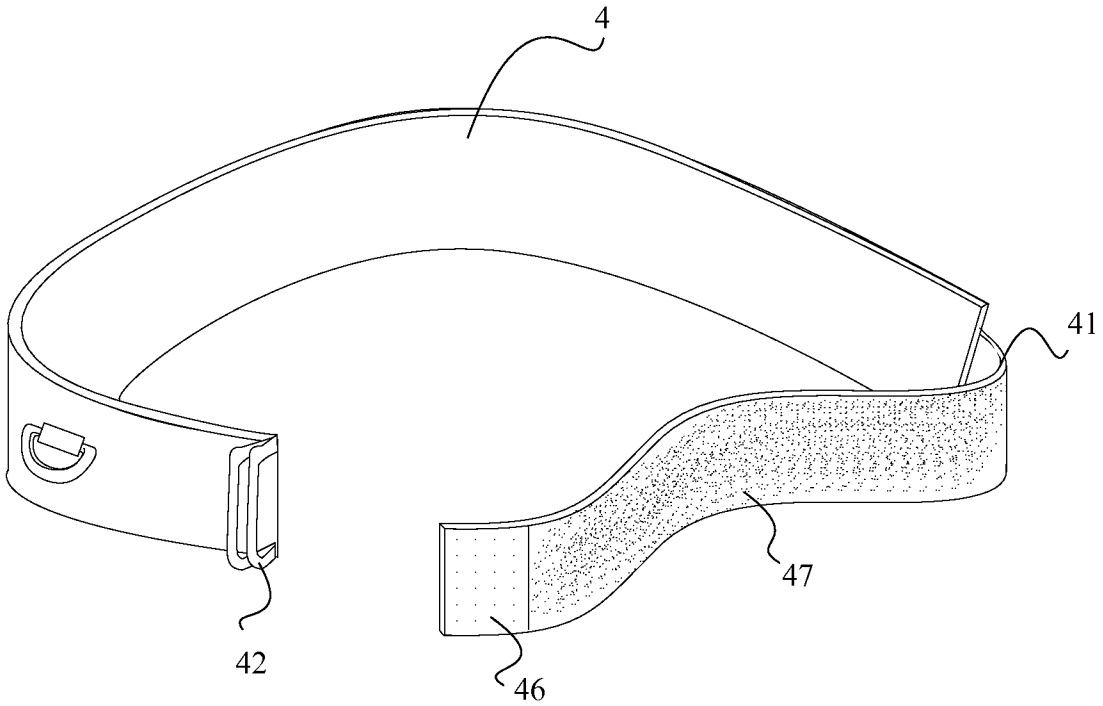
FIG. 13 is another perspective view of the belt.
Figure 14:
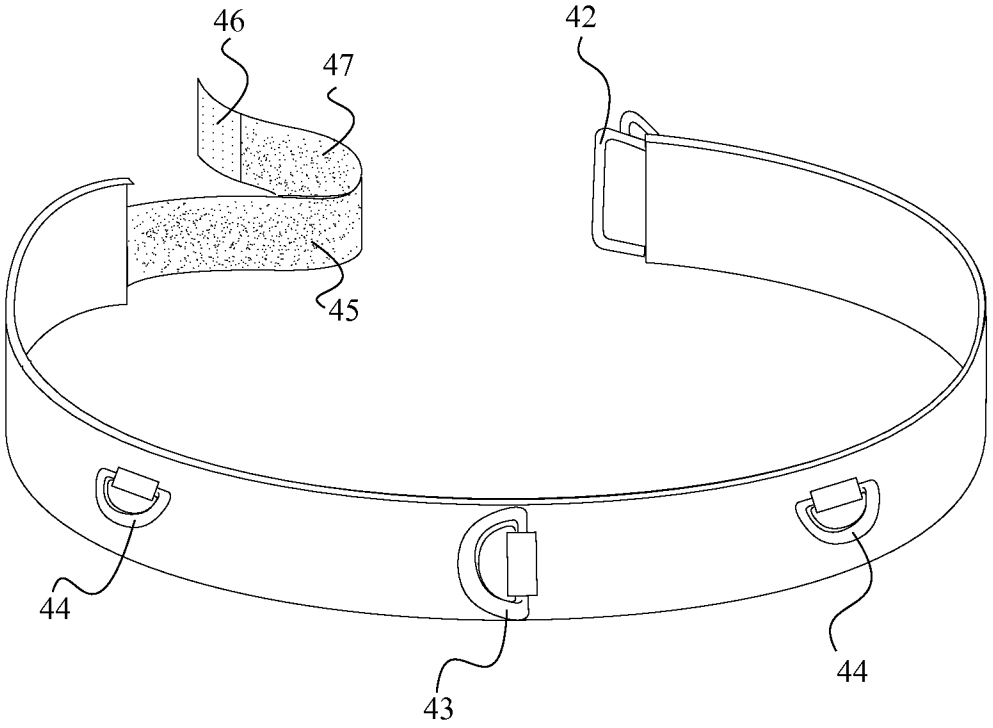
FIG. 14 is a front perspective view of the belt.
Figure 15:
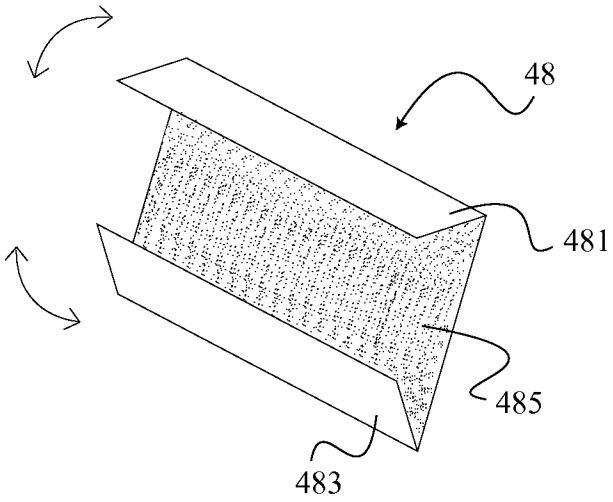
FIG. 15 is a back perspective view of the back attachment.
Figure 16:
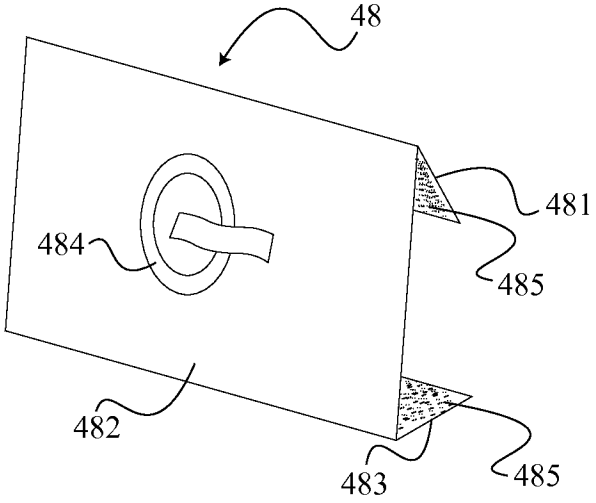
FIG. 16 is a front perspective view of the back attachment.

In reference to FIG. 15 and FIG. 16, the back attachment 48 comprises a top flap 481, a middle flap 482, a bottom flap 483, at least one back ring 484, and a back hook fastener 485. The top flap 481 and the bottom flap 483 are respectively connected to the middle flap's 482 top end and the middle flap's 482 bottom end. The at least one back ring 484 is connected to the middle flap's 482 front surface. In the preferred embodiment, an O-ring is used as the at least one back ring 484, but the at least one back ring 484 is not limited to the O-ring and can be any type of ring, such as D-ring or triangle ring. The back hook fastener 485 is connected to the top flap 481, the middle flap 482, and the bottom flap 483 opposite from the at least one back ring 484. In reference to FIG. 19, the back attachment 48 is shown attached to belt 4. When so attached, the portion of the back hook fastener 485 (FIGS. 15, 16) in the middle flap 482 attaches to the belt 4 with the outside belt loop fastener 47 (FIG. 12), and the portions of the back hook fastener 485 (FIGS. 15, 16) in the top flap 481 and the bottom flap 483 attach to the belt with the inside belt loop fastener 45 (FIG. 12).

Figure 9:
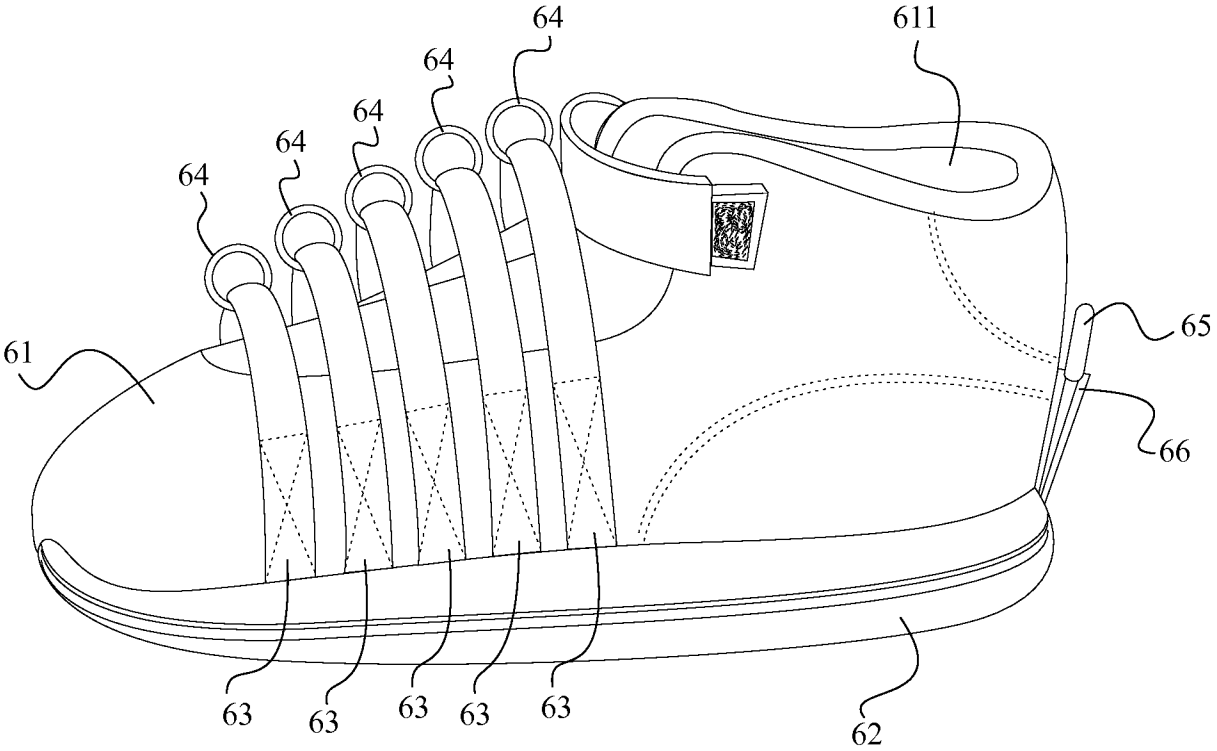
FIG. 9 is a side view of the left shoe or the right shoe.
Figure 10:
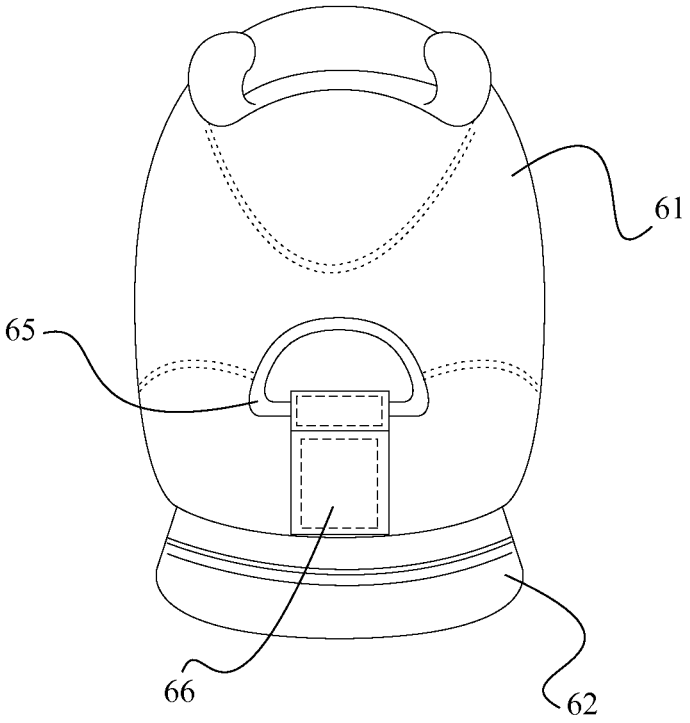
FIG. 10 is a back view of the left shoe or right shoe.

In reference to FIG. 9 and FIG. 10, the left shoe 5 and the right shoe 6 (shown in FIGS. 17-19) each comprises an upper section 61, a sole 62, a plurality of shoe straps 63, a plurality of O-rings 64, a shoe D-ring 65, and a ring attachment 66. The upper section 61 comprises a heel opening 611. The user can insert their left or right heel through the heel opening 611 so that the left shoe 5 or the right shoe 6 can be attached to their left or right foot. The plurality of shoe straps 63 is positioned in front of the heel opening 611. In the preferred embodiment, each of the plurality of shoe straps 63 is a single continuous loop which is positioned around the upper section 61 and connected to the upper section 61. The plurality of shoe straps 63 is either stitched to the upper section's 61 left side, right side, and bottom side or upper section's 61 bottom side. The plurality of O-rings 64 is positioned around the plurality of shoe straps 63. Since the plurality of shoe straps 63 and the upper section 61 have an empty space in between the stitched upper section's 61 left side and right side, the plurality of O-rings 64 freely moves along the plurality of shoe straps 63 in between the stitched upper section's 61 left side and right side. The ring attachment 66 is positioned behind the heel opening 611 and perpendicularly positioned with the plurality of shoe straps 63. The ring attachment's 66 bottom end is connected to the upper section's 61 back side and the bottom side, and the shoe D-ring 65 is movably connected to the ring attachment's 66 top end. The sole 62 is connected to the bottom side of the upper section 61. The sole 62 provides additional support to the plurality of shoe straps 63 and the ring attachment 66 so that the plurality of shoe straps 63 and the ring attachment 66 are secured within the left shoe 5 and the right shoe 6.

Additionally, the plurality of shoe straps 63 can also be attached to the left shoe 5 and the right shoe 6 by implementing a male/female strap clip system. The male/female strap clip system allows the plurality of shoe straps 63 to attached with the left shoe 5 or the right shoe 6, and the plurality of shoe straps 63 no longer comprises the single continuous loop. If the right shoe 6 and the left shoe 5 comprise the male/female strap clip system, a left and right male strap clips connect with the each of the plurality of shoe straps 63, and a plurality of female strap clips connect with the left shoe 5 and the right shoe 6. The users can simply insert the left and right male strap clips into the plurality of female strap clips securing the plurality of shoe straps 63 to the left and right shoe 6. The male/female strap clip system also allows the users to adjust the length of the plurality of shoe straps 63.

Additionally, the plurality of shoe straps 63 can be attached to the left shoe 5 and the right shoe 6 by a plurality of channel connectors. The plurality of channel connectors is positioned between the upper section 61 and the sole 62. Each of the plurality of channel connectors comprises an inside channel, an outside channel, and a connector segment. The inside channel and the outside channel are perpendicularly connected to the connector segment, and only the connector segment positions under the upper section 61. Each of the plurality of shoe straps 63 is adjustably attached with the inside channel and the outside channel, allowing users to interchange the plurality of shoe straps 63 according to different exercises.

Figure 3:
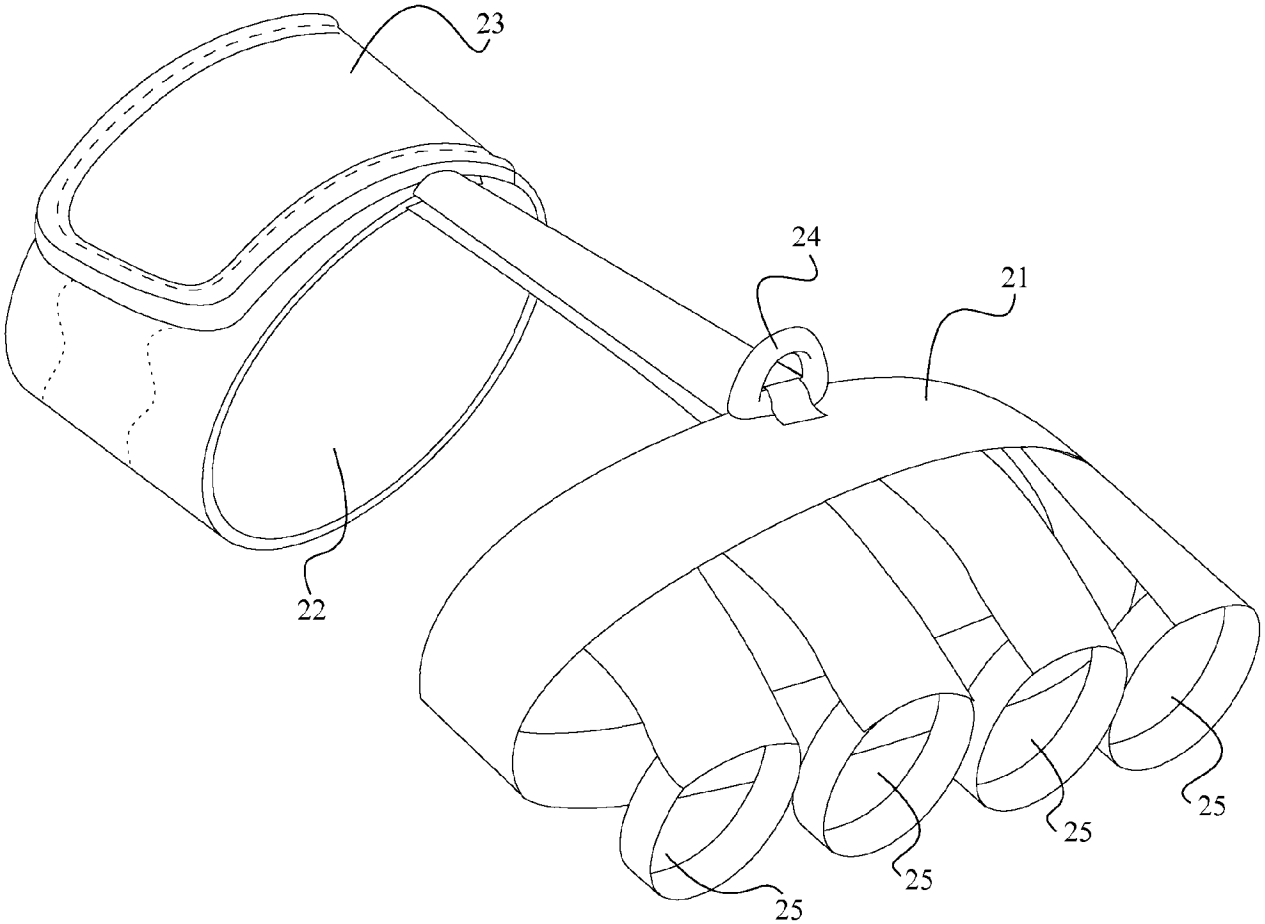
FIG. 3 is a front perspective view of the first embodiment of the left glove or the right glove.
Figure 5:
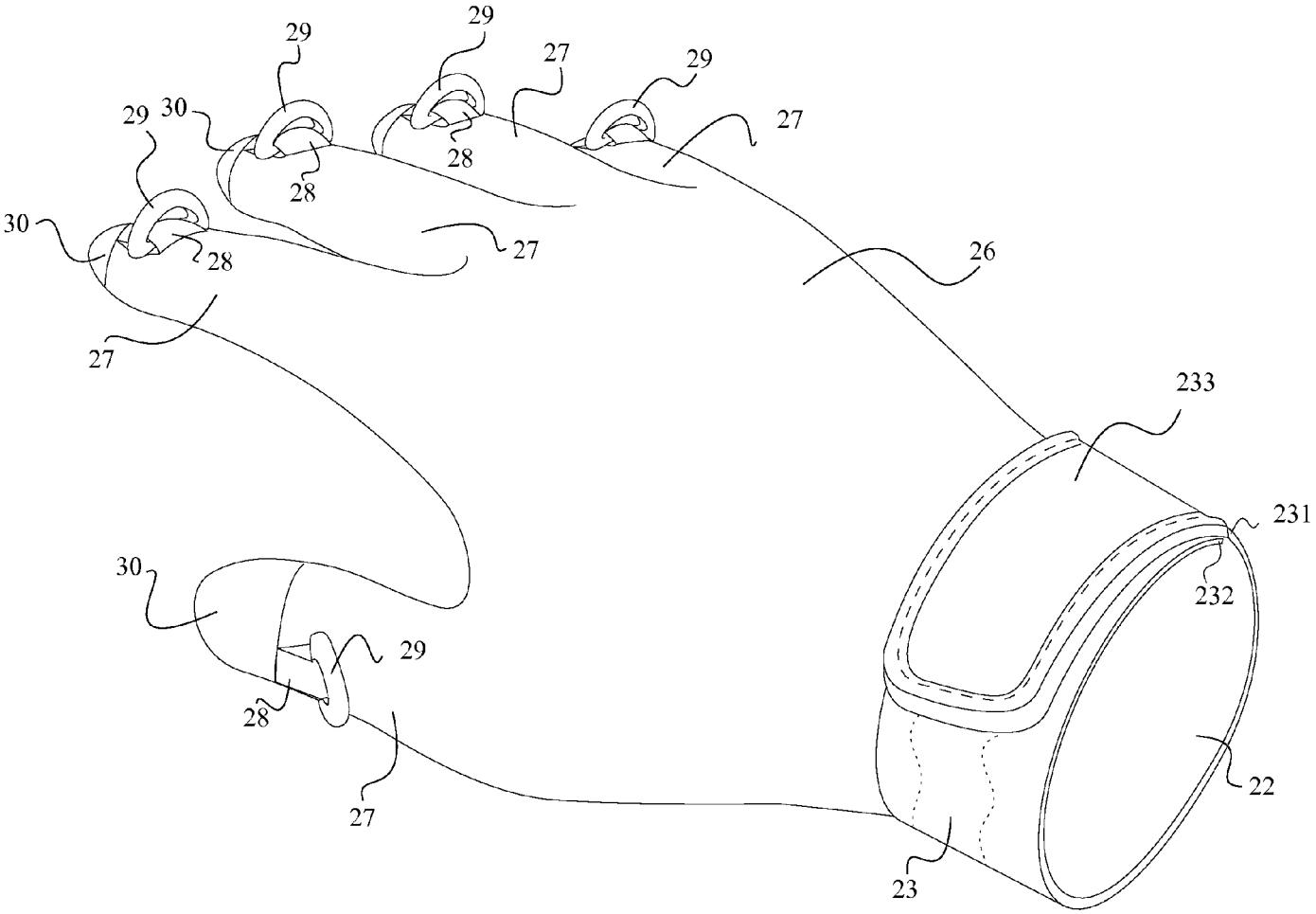
FIG. 5 is a back perspective view of the third embodiment of the left glove or the right glove.
Figure 6:
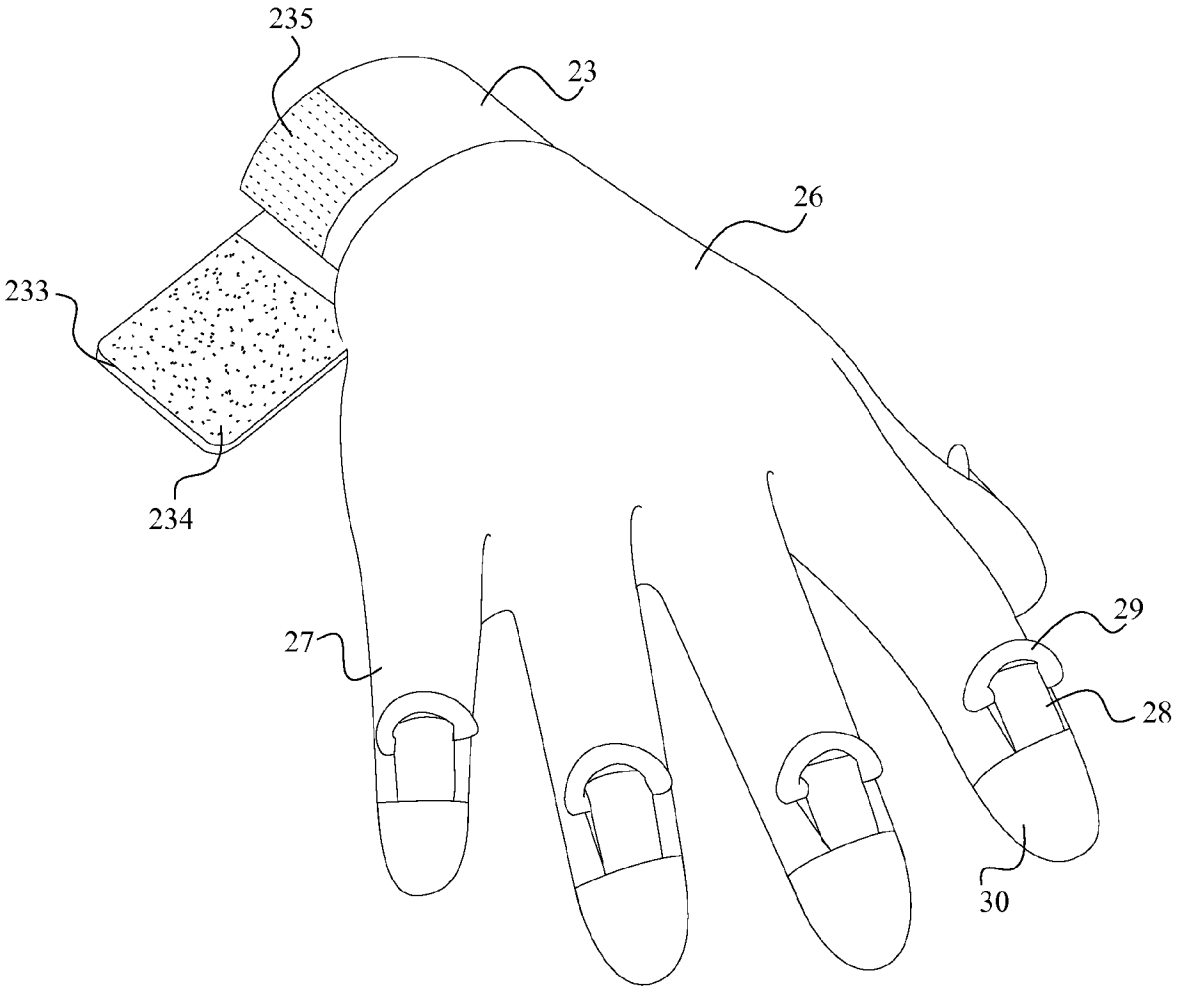
FIG. 6 is a front perspective view of the third embodiment of the left glove or the right glove.

In reference to the first embodiment shown in FIG. 3, the left glove 1 and the right glove 2 (shown in FIGS. 17-19) each comprises a glove support structure 21, a wrist opening 22, a wristband 23, a glove D-ring 24, and a plurality of finger openings 25. The wristband 23 is connected to the glove support structure 21 from one end, and the plurality of finger openings 25 is connected to the glove support structure 21 opposite from the wristband 23. The glove support structure 21 is made from many straps, and comprises the shape of a human hand. The wrist opening 22 is positioned within the wristband 23. When the users insert their hand through the wrist opening 22 into the glove support structure 21, the user's fingers come through the plurality of finger openings 25. The wristband 23 allows the user to adjust the comfort fit of the left glove 1 or the right glove 2. As shown in FIG. 5, wristband 23 comprises a first end 231, a second end 232, and an adjustable wrist strap 233; as shown in FIG. 6 the wristband further includes a glove loop fastener 234, and a glove hook fastener 235. The adjustable wrist strap 233 is connected to the wristband 23 from the first end 231 and positioned on the outside surface of the wristband 23. The glove hook fastener 235 is connected to the second end 232 from the outside surface of the wristband 23. The glove loop fastener 234 is positioned in between the adjustable wrist strap 233 and the glove hook fastener 235, and the glove loop fastener 234 is connected to the adjustable wrist strap 233. Since the first end 231 and the second end 232 are attached together by the glove hook fastener 235 and the glove loop fastener 234, the users can adjust the circumference of the wristband 23 by the adjustable wrist strap 233. The glove D-ring 24 is movably connected to the glove support structure 21. The glove D-ring 24 is positioned adjacent with the plurality of finger openings 25 and positioned on the glove support structure's 21 top side, wherein the top side is adjacently positioned with the hand knuckles and the wrist.

Figure 4:
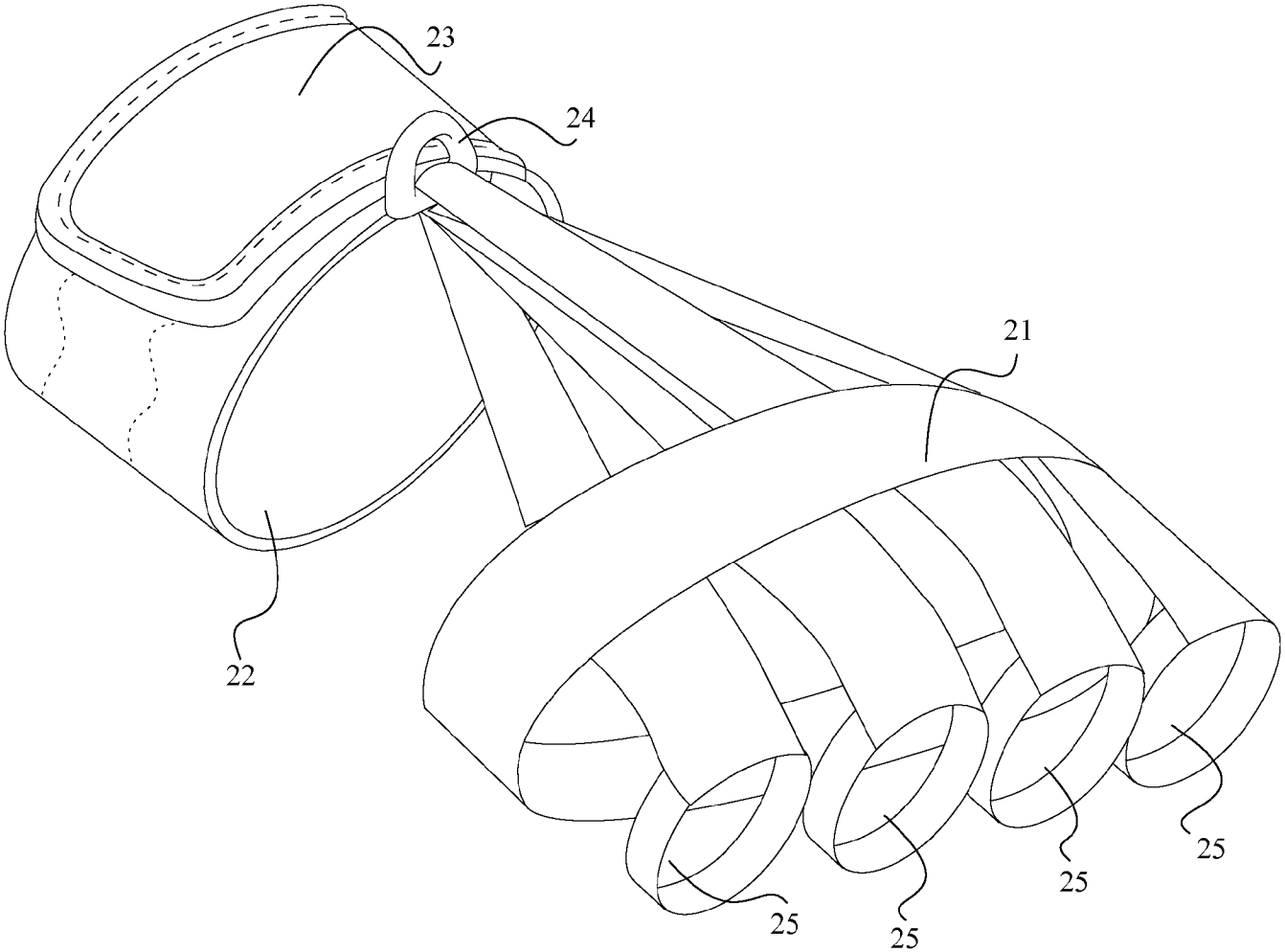
FIG. 4 is a front perspective view of the second embodiment of the left glove or the right glove.

In reference to the second embodiment shown in FIG. 4, the left glove 1 and the right glove 2 (shown in FIGS. 17-19) each comprises the glove support structure 21, the wrist opening 22, the wristband 23, the glove D-ring 24, and the plurality of finger openings 25. The wristband 23 is connected to the glove support structure 21 from one end, and the plurality of finger openings 25 is connected to the glove support structure 21 opposite from the wristband 23. The glove support structure 21 is made from many straps, and comprises the shape of a human hand. The wrist opening 22 is positioned within the wristband 23. When the users insert their hands through the wrist opening 22 into the glove support structure 21, the user's fingers come through the plurality of finger openings 25. The wristband 23 allows the user to adjust the comfort fit of the left glove 1 or the right glove 2. The wristband 23 comprises the first end 231, the second end 232, the adjustable wrist strap 233, the glove loop fastener 234, and the glove hook fastener 235. The adjustable wrist strap 233 is connected to the wristband 23 from the first end 231 and positioned on the outside surface of the wristband 23. The glove hook fastener 235 is connected to the second end 232 from the outside surface of the wristband 23. The glove loop fastener 234 is positioned in between the adjustable wrist strap 233 and the glove hook fastener 235, and the glove loop fastener 234 is connected to the adjustable wrist strap 233. Since the first end 231 and the second end 232 are attached together by the glove hook fastener 235 and the glove loop fastener 234, the users can adjust the circumference of the wristband 23 by the adjustable wrist strap 233. The glove D-ring 24 is movably connected to the glove support structure 21. The glove D-ring 24 is positioned adjacent with the wristband 23 and positioned on the glove support structure's 21 top side, wherein the top side is adjacently positioned with the hand knuckles and the wrist.

In reference to the third embodiment shown in FIG. 5 and FIG. 6, the left glove 1 and the right glove 2 (shown in FIGS. 17-19) each comprises an inner glove 26, a plurality of fingertip connectors 28, a plurality of glove D-rings 29, and a fingertip connector cover 30. The inner glove 26 comprises the wrist opening 22, a plurality of finger sleeves 27, and the wristband 23. The wristband 23 is connected to the inner glove 26 from one end, and the plurality of finger sleeves 27 is positioned with the inner glove 26 opposite from the wristband 23. The inner glove 26 is made out of high strength stretchable fabric, and comprises the shape of a human hand. The wrist opening 22 is positioned within the wristband 23. When the users insert their hands through the wrist opening 22 into the inner glove 26, the user's fingers traverse into the plurality of finger sleeves 27. The wristband 23 allows the user to adjust the comfort fit of the left glove 1 or the right glove 2. The wristband 23 comprises the first end 231, the second end 232, the adjustable wrist strap 233, the glove loop fastener 234, and the glove hook fastener 235. The adjustable wrist strap 233 is connected to the wristband 23 from the first end 231 and positioned on the outside surface of the wristband 23. The glove hook fastener 235 is connected to the second end 232 from the outside surface of the wristband 23. The glove loop fastener 234 is positioned in between the adjustable wrist strap 233 and the glove hook fastener 235, and the glove loop fastener 234 is connected to the adjustable wrist strap 233. Since the first end 231 and the second end 232 are attached together by the glove hook fastener 235 and the glove loop fastener 234, the users can adjust the circumference of the wristband 23 by the adjustable wrist strap 233. The plurality of fingertip connectors 28 is firmly connected with the plurality of finger sleeves 27 around the fingernails, and the plurality of glove D-rings 29 is movably connected with the plurality of fingertip connectors 28 from the free end. In the third embodiment, the plurality of glove D-rings 29 is positioned adjacent with the fingernails of the user. The fingertip connector cover 30 is positioned over the plurality of fingertip connectors 28 and connected to the inner glove 26.

Figure 7:
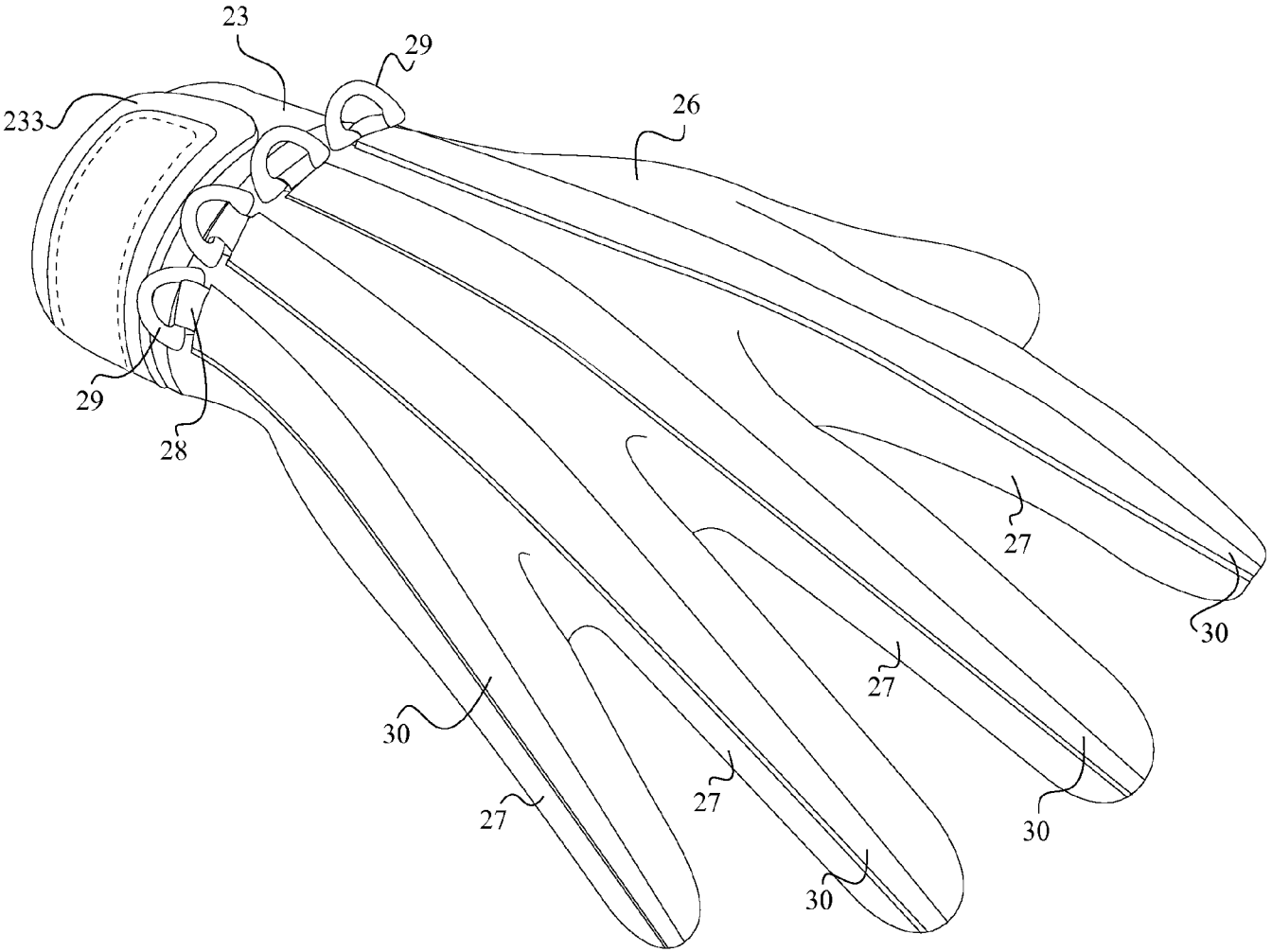
FIG. 7 is a front perspective view of the fourth embodiment of the left glove or the right glove.
Figure 8:
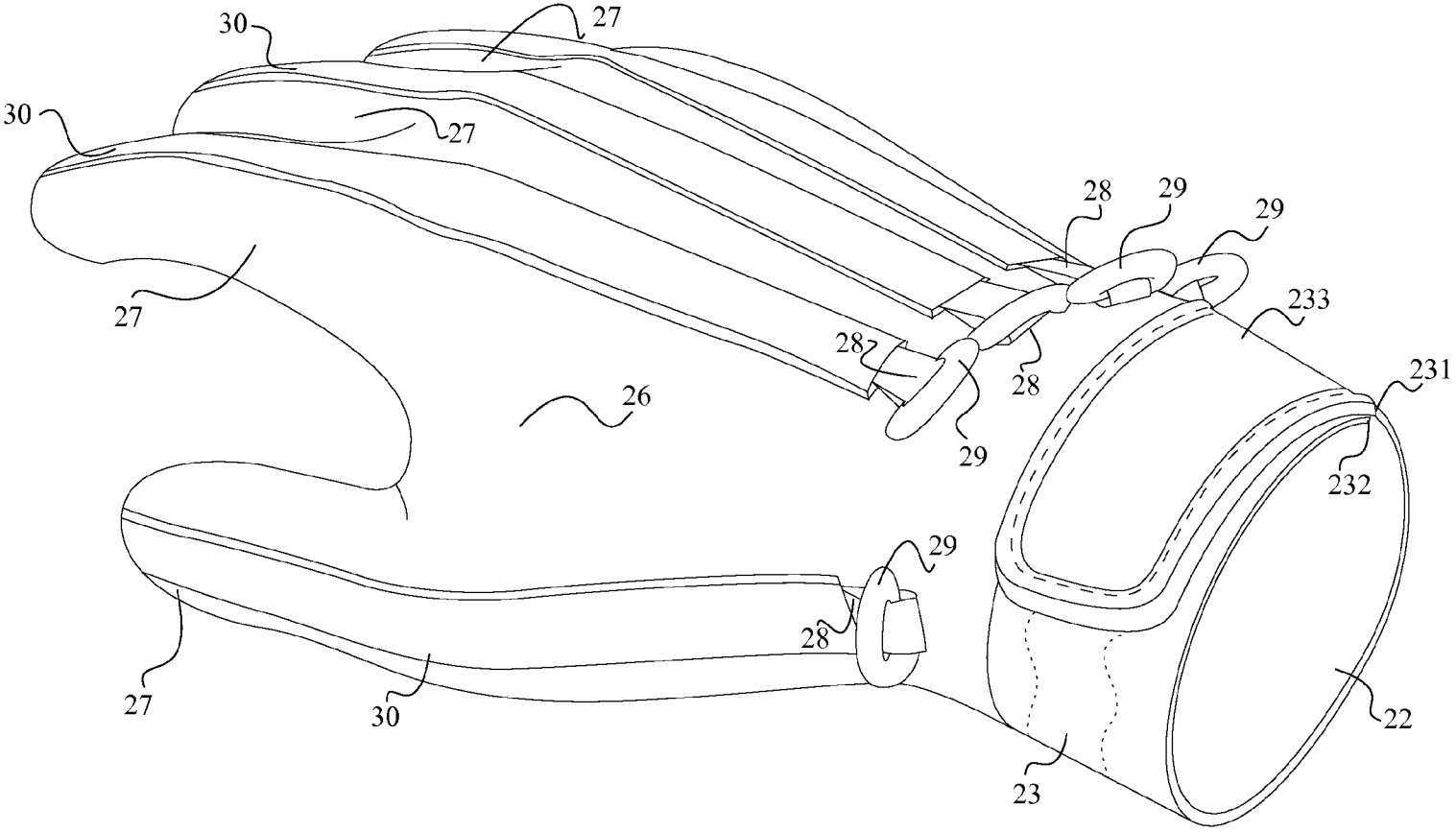
FIG. 8 is a back perspective view of the fourth embodiment of the left glove or the right glove.

In reference to the fourth embodiment shown in FIG. 7 and FIG. 8, the left glove 1 and the right glove 2 (shown in FIGS. 17-19) each comprises the inner glove 26, the plurality of fingertip connectors 28, the plurality of glove D-rings 29, and the fingertip connector cover 30. The inner glove 26 comprises the wrist opening 22, the plurality of finger sleeves 27, and the wristband 23. The wristband 23 is connected to the inner glove 26 from one end, and the plurality of finger sleeves 27 is positioned with the inner glove 26 opposite from the wristband 23. The inner glove 26 is made out of high strength stretchable fabric, and comprises the shape of a human hand. The wrist opening 22 is positioned within the wristband 23. When the users insert their hands through the wrist opening 22 into the inner glove 26, the user's fingers traverse into the plurality of finger sleeves 27. The wristband 23 allows the user to adjust the comfort fit of the left glove 1 or the right glove 2. The wristband 23 comprises the first end 231, the second end 232, the adjustable wrist strap 233, the glove loop fastener 234, and the glove hook fastener 235. The adjustable wrist strap 233 is connected to the wristband 23 from the first end 231 and positioned on the outside surface of the wristband 23. The glove hook fastener 235 is connected to the second end 232 from the outside surface of the wristband 23. The glove loop fastener 234 is positioned in between the adjustable wrist strap 233 and the glove hook fastener 235, and the glove loop fastener 234 is connected to the adjustable wrist strap 233. Since the first end 231 and the second end 232 are attached together by the glove hook fastener 235 and the glove loop fastener 234, the users can adjust the circumference of the wristband 23 by the adjustable wrist strap 233. The plurality of fingertip connectors 28 is firmly connected with the plurality of finger sleeves 27 around the finger nails, but extends toward the wrist of the user, and the plurality of glove D-rings 29 is movably connected with the plurality of fingertip connectors 28 from the free end. In the fourth embodiment, the plurality of glove b-rings 29 is positioned adjacent with the wrist of the user. The fingertip connector cover 30 is positioned over the plurality of fingertip connectors 28 and connected to the inner glove 26. Since the fingertip connector cover 30 is not connected to the plurality of fingertip connectors 28, the plurality of fingertip connectors 28 easily moves inside the connector cover while keeping the plurality of fingertip connectors 28 inline.

Figure 11:
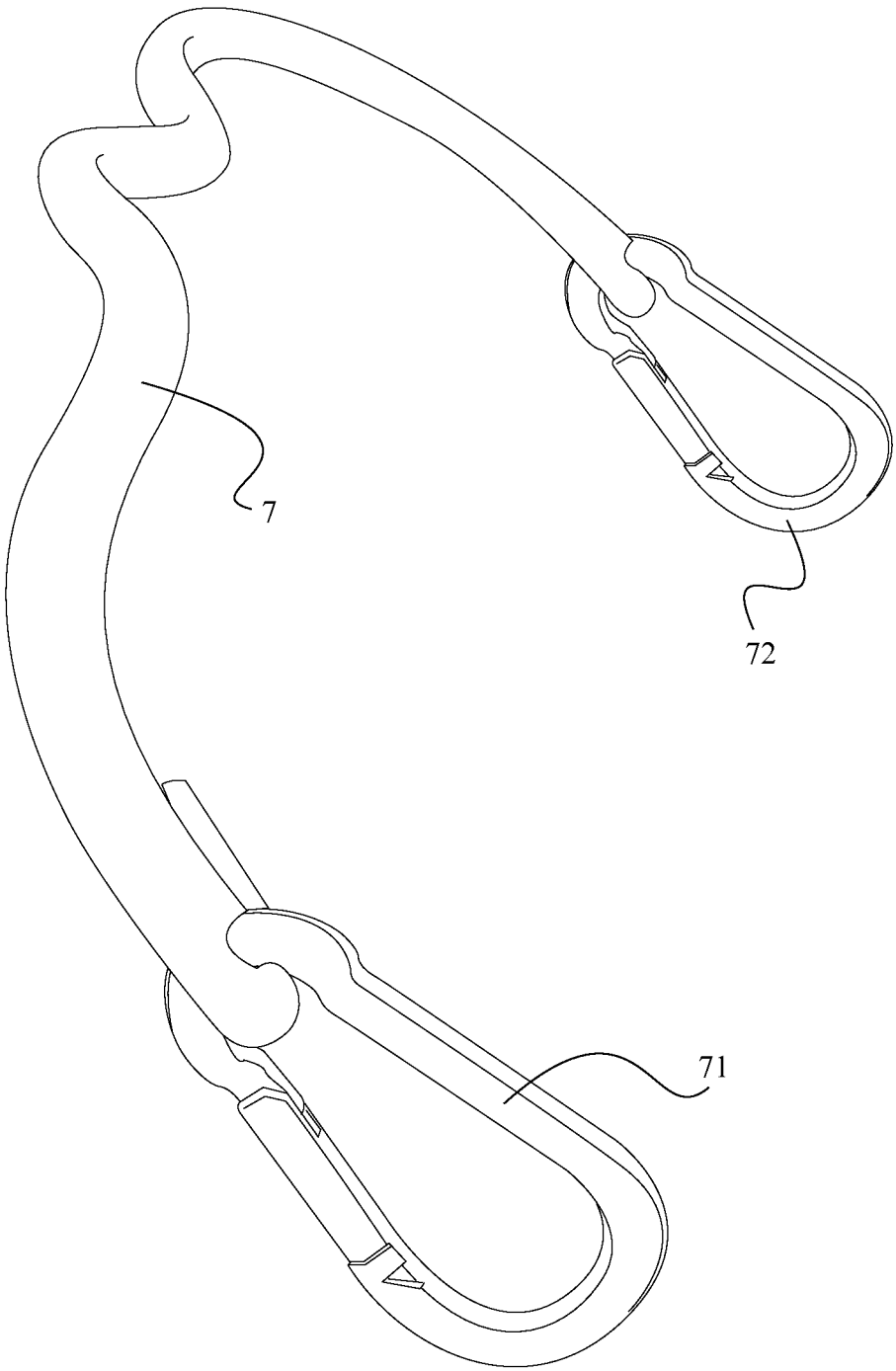
FIG. 11 is a perspective view of the resistance band.

In reference to FIG. 11, the plurality of resistance bands 7 each comprises a first attachment clip 71 and a second attachment clip 72. First and second attachment clips 71 and 72, are attached to respective ends of each resistance band 7. The connection between the each of the plurality of resistance bands 7 and the first attachment clip 71 or the second attachment clip 72 may be a rotatable attachment or a fixed attachment. The plurality of resistance bands 7 is made from elastically expandable materials such as rubber. The first attachment clip 71 and the second attachment clip 72 are made from light weighted and high strength materials. The first attachment clip 71 and the second attachment clip 72 have a movable rod which can be controlled by the user so that the plurality of resistance bands 7 can be attached with other components, such as the left glove 1, right glove 2, belt 4, vest 3, left shoe 5, and right shoe 6.

In the preferred embodiment, the left glove 1 and the right glove 2 are attached to the vest 3 by the plurality of resistance bands 7. The first attachment clips 71 are attached with the glove D-ring 24 in the first and second embodiments or with the plurality of glove D-rings 29 in the third and fourth embodiments, and the second attachment clips 72 are attached with the plurality of vest rings 33. Additionally, the second attachment clips 72 can be attached with the plurality of vertical rings 43, the plurality of horizontal rings 44, the plurality of O-rings 64, and the shoe D-ring 65. In the preferred embodiment, the left shoe 5 and the right shoe 6 are attached to the belt 4 by the plurality of resistance bands 7. The first attachment clips 71 are attached with the plurality of O-rings 64 and the shoe D-ring 65, and the second attachment clips 72 are respectively attached with the plurality of vertical rings 43 and the plurality of horizontal rings 44. Additionally, the second attachment clips 72 can be attached with the plurality of vest rings 33 and the glove D-ring 24 or the plurality of glove D-rings 29. Additionally the vest 3 can be attached to the belt 4 by the plurality of resistance band. The first attachment clips 71 are attached with the plurality of vest rings 33, and the second attachment clips 72 are attached with the plurality of vertical rings 43 and/or with the plurality of horizontal rings 44.

Since the attachment between the left glove 1, right glove 2, belt 4, vest 3, left shoe 5, and right shoe 6 are implemented from the plurality of resistance bands 7, the users can perform variety of exercises while keeping their hands free from the present invention. The resistance level between each components attachment may be changed by the plurality of resistance bands 7. The plurality of resistance bands 7 may comprise a different resistance level bands such as, soft bands, moderate bands, or hard bands. Since more than one resistance bands can be attached between the components, user can also attached multiple resistance bands for additional resistance.

Although the invention has been explained in relation to its preferred embodiment, it is to be understood that many other possible modifications and variations can be made without departing from the spirit and scope of the invention as hereinafter claimed.

What is claimed is:

1. A belt for use in a sport performance enhancing system having an elastomeric band connected between a belt and a shoe comprising:

an adjustable strap connected to the belt, the strap including an inside loop fastener, an outside loop fastener, and a hook fastener, the inside loop fastener extending along an inside surface of the strap and the outside loop fastener and the hook fastener being on an outside surface of the strap;

at least one attachment ring element connected to the belt adapted to receive an elastomeric band; and a back attachment member comprising a middle portion having a front surface and a back surface opposite the front surface, the front surface including a back ring element connected thereto adapted to receive an elastomeric band, and the back surface including a hook fastener connected thereto, wherein the hook fastener on the back surface of the middle portion attaches to the outside loop fastener of the strap to secure the back attachment member to the belt.

2. The belt as claimed in claim 1, wherein the back attachment member further comprises a top flap connected to a top edge of the middle portion, and a bottom flap connected to a bottom edge of the middle portion.

3. The belt as claimed in claim 2, wherein the top flap and the bottom flap each have a back surface with hook fasteners connected thereto, and the hook fasteners on the back surface of the top and bottom flaps attach to the inside loop fasteners to further secure the back attachment to the belt.

4. The belt as claimed in claim 3, wherein the hook fasteners on the back surfaces cooperate with the loop fasteners on the inside and outside surfaces to adjustably connect the back ring element to the belt.

5. The belt as claimed in claim 1, wherein the at least one attachment ring element comprises a plurality of horizontal rings connected around the belt.

6. The belt as claimed in claim 5, wherein the plurality of horizontal rings are D-rings or O-rings positioned parallel to an edge of the belt.

7. The belt as claimed in claim 1, wherein the at least one attachment ring element comprises a plurality of vertical rings connected around the belt.

8. The belt as claimed in claim 7, wherein the plurality of vertical rings are D-rings or O-rings positioned perpendicular to an edge of the belt.

9. The belt as claimed in claim 1, wherein the strap is connected to a first end of the belt and a double D-ring buckle is connected to a second end of the belt, the strap being insertable between the D-rings of the buckle for securing the belt to a user.

10. The belt as claimed in claim 1, wherein the hook fastener on the outside surface of the strap is at one end of the strap and is attachable to the outside loop fastener for securing the belt to a user.

11. A sport performance enhancing system comprising:

a belt adapted to be secured about the waist of a user;

a pair of shoes; and at least one elastomeric band connected between the belt and the shoes, wherein the belt includes:

an adjustable strap connected to the belt, the strap including an inside loop fastener and an outside loop fastener, the inside loop fastener extending along an inside surface of the strap and the outside loop fastener being on an outside surface of the strap;

at least one attachment ring element connected to the belt; and a back attachment member comprising a middle portion having a front surface and a back surface opposite the front surface, the front surface including a back ring element connected thereto, and the back surface including a hook fastener connected thereto, wherein the hook fastener on the back surface of the middle portion attaches to the outside loop fastener of the strap to secure the back attachment member to the belt, wherein each shoe includes:

an upper section including a left side, a right side and a bottom side;

a sole attached to the bottom side;

a heel opening in the upper section;

a plurality of straps extending across the upper section in front of the heel opening, each strap having a first end portion attached to the left side of the upper section adjacent the sole and a second end portion attached to the right side of the upper section adjacent the sole; and a ring positioned around each of the straps, wherein the ring on each strap is freely movable along the strap between the left side of the upper section and the right side of the upper section, and wherein the at least one elastomeric band includes first and second attachment clips connected to respective ends of the at one elastomeric band, the at least one elastomeric band extending through the at least one ring element connected to the belt and one of the attachment clips attaching to one of the rings on one shoe and the other of the attachment clips attaching to one of the rings on the other shoe.

* * * * *